United States Patent [19]

Brookes

[11] Patent Number: 4,707,162

[45] **Date of Patent: * Nov. 17, 1987**

[54] MINERAL SLURRIES

[75] Inventor: David A. Brookes, Orpington, England

[73] Assignee: The British Petroleum Company p.l.c., London, England

[ * ] Notice: The portion of the term of this patent subsequent to Jun. 25, 2002 has been disclaimed.

[21] Appl. No.: 639,389

[22] Filed: Aug. 10, 1984

[30] Foreign Application Priority Data

Aug. 19, 1983 [GB] United Kingdom ..... 8322432

[51] Int. Cl.[4] ..... C10L 1/32

[52] U.S. Cl. ..... 44/51; 406/47; 406/49; 406/197

[58] Field of Search ..... 44/51; 406/47, 49, 197

[56] References Cited

U.S. PATENT DOCUMENTS 3,168,350 2/1965 Phinney ..... 44/51
3,908,912 9/1975 Irons et al. ..... 241/20
4,132,365 1/1979 Verschuur ..... 241/21
4,465,495 8/1984 Scheffee ..... 44/51
4,525,173 6/1985 Baker et al. ..... 44/51

*Primary Examiner*—William R. Dixon, Jr.
*Assistant Examiner*—Margaret B. Medley
*Attorney, Agent, or Firm*—Morgan & Finnegan

[57] ABSTRACT

A pumpable slurry of material particles in water comprises coarse mineral particles having a particle size in the range 5 to 50 mm and fine mineral particles having a size less than 200 micron. The slurry contains 82 to 85%, preferably 83–85%, by weight of mineral particles based on the combined weight of the mineral particles and water. At least 30% by weight of the mineral particles are in the form of coarse particles, 10 to 40% by weight are in the form of fine particles and the balance to 100% by weight are intermediate sized particles.

The mineral particles are preferably coal.

Slurries of this concentration have special properties in that they are sufficiently fluid to be pumped through a pipeline, yet sufficiently solid when static to be handled by grabs and similar devices.

8 Claims, 4 Drawing Figures

Size distribution : Sample 1 after run 2.

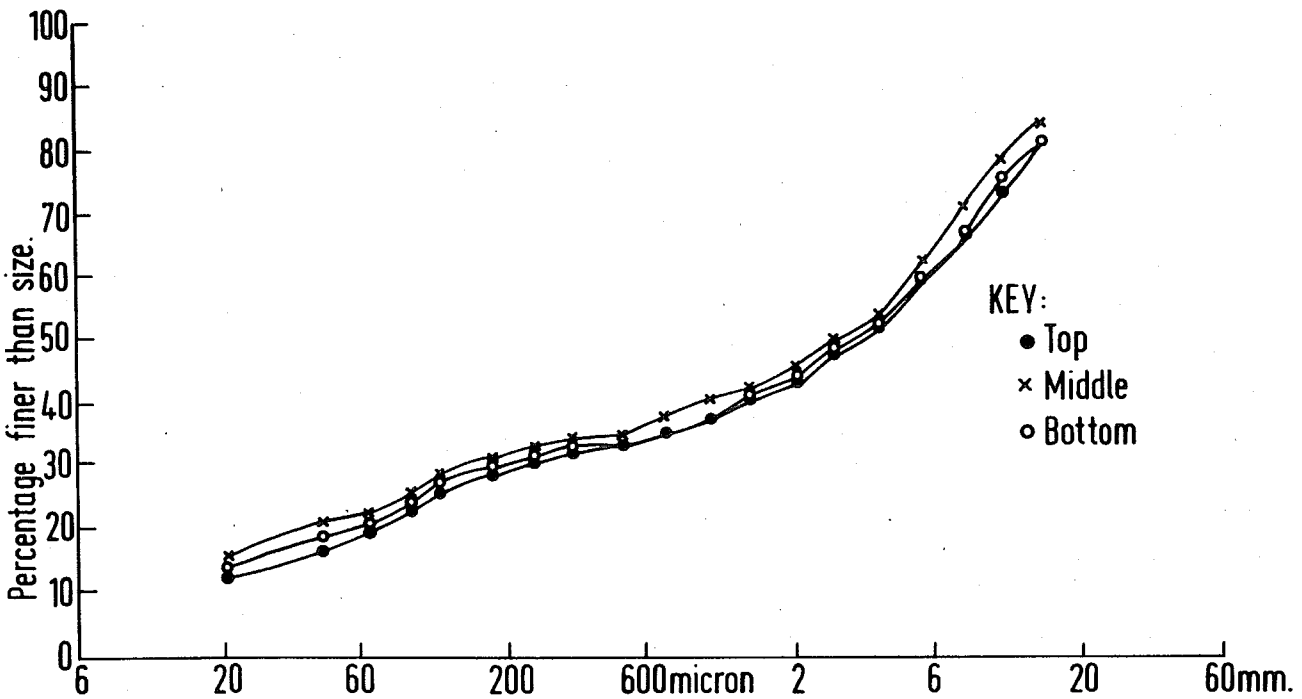
FIG.1 Size distribution : Sample 1 after run 2.

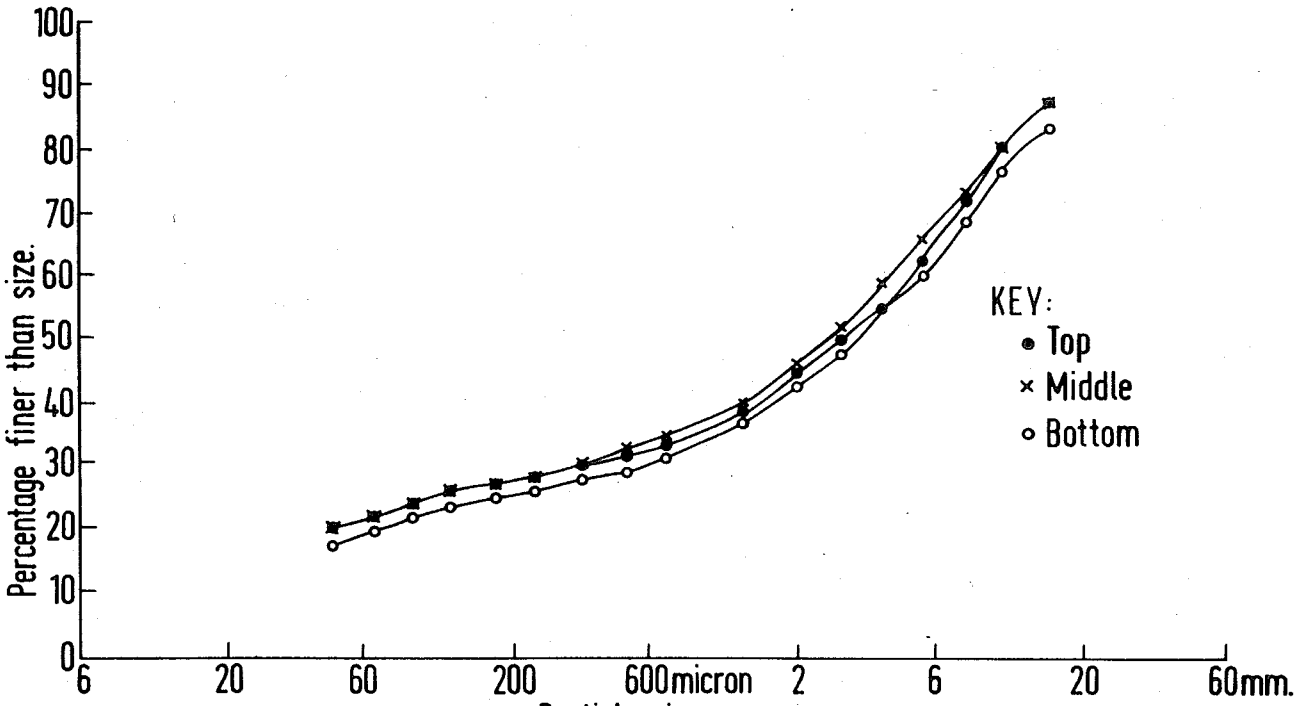
FIG. 2 Size distribution: Sample 2 after run 3.

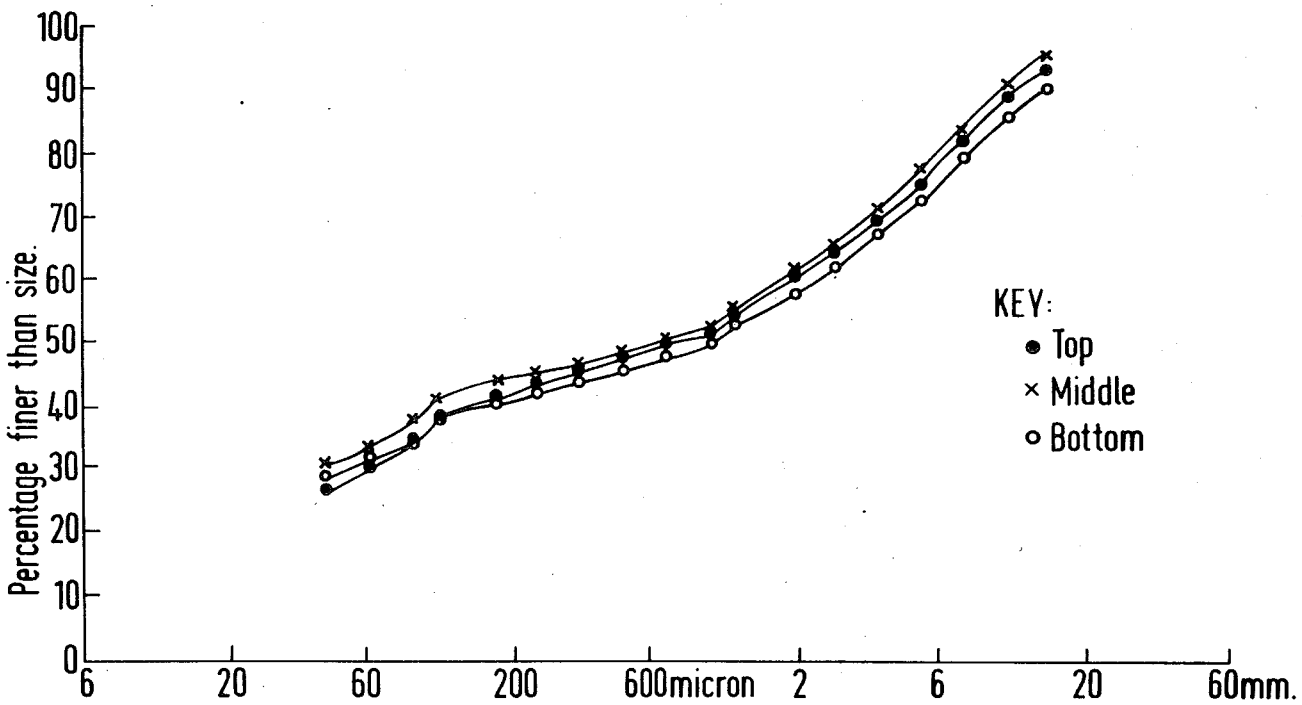
FIG. 3 Size distribution : Sample 3 after run 6.

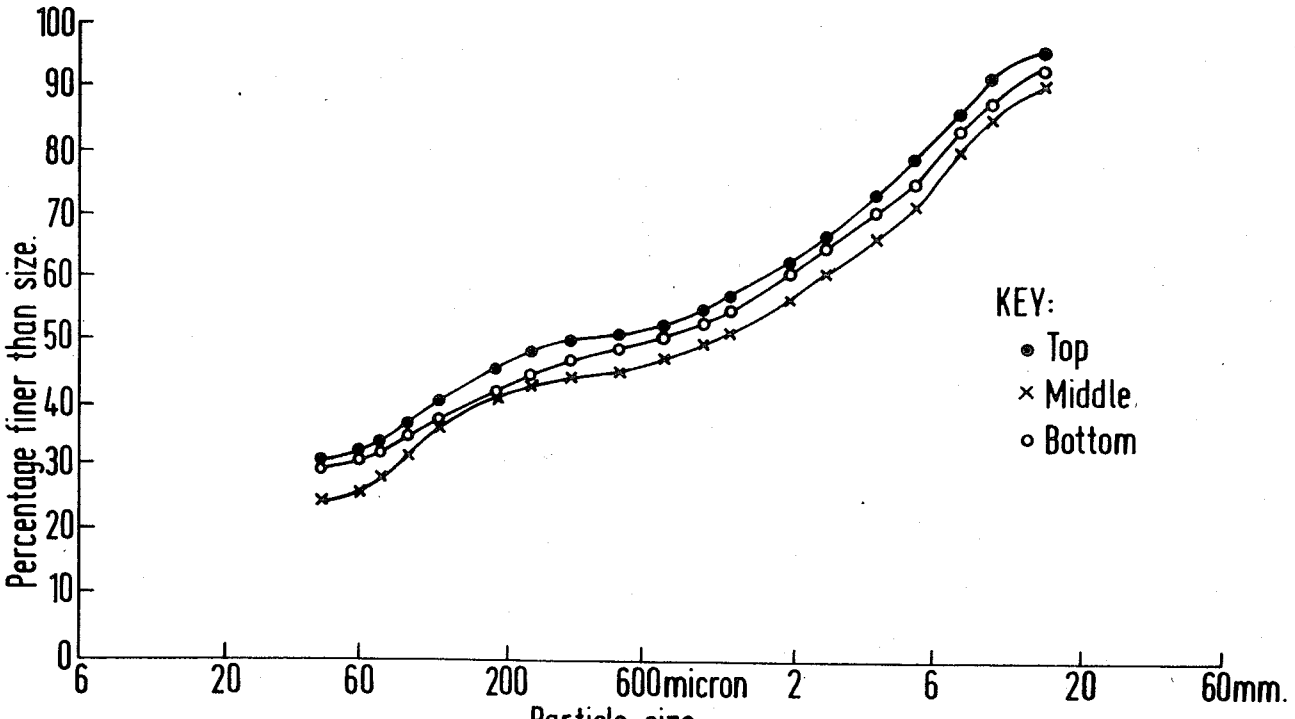
FIG.4 Size distribution: Sample 3 after run 7.

MINERAL SLURRIES

This invention relates to a pumpable slurry of particles of a mineral, such as coal, in water and to a method for transporting such a slurry.

There have been previous proposals to transport coal by preparing slurries of particles of coal in water and pumping the slurries through pipelines. These slurries tend to bé unstable and the coal tends to sediment.

GB No. 2068056-A discloses a method of transporting coal as a coal water slurry through a pipeline wherein the coal in the slurry comprises at least 95% by weight of coal particles having a particle size smaller than 700 micron and at most 10% by weight of coal particles having a particle size smaller than 44 micron.

There have also been proposals to provide slurries of coal particles in water for use as fuels. However, such slurries are based on even finer particles.

Our copending European patent application No. 83302666.9 discloses a pumpable slurry of mineral particles in water comprising coarse mineral particles having a particle size in the range 5 to 50 mm and fine mineral particles having a size less than 200 micron wherein the slurry contains 50 to 85% by weight of mineral particles based on the combined weight of mineral particles and water, at least 30% by weight of the mineral particles being in the form of coarse particles, 10% to 40% by weight being in the form of fine particles, and the balance to 100% by weight being intermediate sized particles.

Above 85% by weight, the slurry becomes too viscous to be pumped and below 50% the slurry is unstable and suspended particles settle out.

We have now discovered that slurries having a solids content in the narrow range of 82 to 85% by weight have special properties in that they are sufficiently fluid to be pumped through a pipeline and yet they are sufficiently solid when static to be handled by grabs and similar devices.

Thus according to the present invention there is provided a pumpable slurry of mineral particles in water comprising coarse mineral particles having a particle size in the range 5 to 50 mm and fine mineral particles having a size less than 200 micron wherein the slurry contains 82 to 85%, preferably 83–85%, by weight of mineral particles based on the combined weight of the mineral particles and water, at least 30% by weight of the mineral particles being in the form of coarse particles, 10 to 40% by weight being in the form of fine particles and the balance to 100% by weight being intermediate sized particles.

Preferably the fine particles contain a significant proportion, e.g. at least 50% by weight, of particles less than 100 micron in size.

Desirably the fine particles have a low content, eg less than 10% by weight, of particles less than 10 microns in size since these tend to increase the viscosity of the slurry, although some at least should be present.

Conveniently the mineral particles have a continuous particle size distribution. This may be chosen to obtain the closest packing of particles.

The preferred mineral for use in a slurry according to the present invention is coal.

The slurry is very suitable for transportation by sea since it is stable and shows little tendency to settle in ships' tanks even when subjected to ships' motion.

A particularly useful technique lies in pumping a slurry containing 65% to 80% by weight of mineral particles through a pipeline from a mine to a harbour and partially dewatering the slurry prior to loading it on to a ship.

Thus according to a further aspect of the present invention there is provided a method for transporting a slurry of mineral particles in water, which method comprises pumping through a pipeline a pumpable slurry of mineral particles in water comprising coarse mineral particles having a particle size in the range 5 to 50 mm and fine mineral particles having a size less than 200 micron wherein the slurry contains 65 to 80% by weight of mineral particles based on the combined weight of mineral particles and water, at least 30% by weight of the mineral particles being in the form of coarse particles, 10 to 40% by weight being in the form of fine particles and the balance to 100% being intermediate sized particles; dewatering the slurry to give a solids content of from 82 to 85% by weight and pumping the dewatered slurry into a container for further transporting.

Suitable dewatering equipment is disclosed in our copending British patent application No. 8322275.

This discloses apparatus for the removal of liquid from a slurry of solid particles in a liquid which apparatus comprises (a) an elongated internal tubular chamber for the passage of slurry, the walls of the chamber being permeable to liquid, (b) an external annular chamber surrounding the internal chamber for receiving the permeated liquid and (c) an outlet or outlets from the external annular chamber.

The present invention is illustrated with reference to the following examples.

EXAMPLES

Three batches of coal of varying particle size distribution were taken. Particle size distribution data is given in the accompanying FIGS. 1–4.

Samples from each batch were taken and placed in a ships' motion simulator which was basically a box with a square cross section having the following dimensions: 0.8m×0.8m×1.2m subjected to the following motions:

| | Amplitude | Period |
|---|---|---|
| Roll | 14° | 17 s |
| Pitch | 15° | 17 s |
| Heave | 2.3 m | 8.5 s |

The following results were obtained.

TABLE 1

Summary of Results

| Run No | Sample No | Preparation | Moisture Content: Before Run Overall % | Moisture Content: After Run by layer % | Moisture Content: After Run Overall % | Bulk Density After Run: Overall By layer tonnes $m^{-3}$ | |
|---|---|---|---|---|---|---|---|
| 1 | 1 | Sample as received. | — | Top — | 17.8 | T | — |
| | | | | Middle — | | M | |

TABLE 1-continued

Summary of Results

| Run No | Sample No | Preparation | Moisture Content Before Run Overall % | After Run by layer % | | After Run Overall % | Bulk Density After Run Overall | By layer tonnes $m^{-3}$ | |
|---|---|---|---|---|---|---|---|---|---|
| | | | | Bottom | — | | | B | |
| 2 | 1 | Sample diluted by addition of water. | — | T | 21.6 | 22.5 | 1.34 | T | — |
| | | | | M | 30.6 | | | M | 1.35 |
| | | | | B | 16.6 | | | B | 1.42 |
| 3 | 2 | Sample as received. | — | T | 21.5 | 20.0 | 1.36 | T | 1.26 |
| | | | | M | 19.6 | | | M | 1.30 |
| | | | | B | 17.1 | | | B | 1.55 |
| 4 | 2 | Sample partially dried to reduce moisture content. | — | T | 16.3 | 16.8 | 1.22 | T | 1.11 |
| | | | | M | 16.9 | | | M | 1.13 |
| | | | | B | 17.2 | | | B | 1.46 |
| 5 | 2 | Sample diluted by addition of water. | 16.8 | T | 16.5 | 16.9 | 1.25 | T | 1.01 |
| | | | | M | 16.6 | | | M | 1.42 |
| | | | | B | 17.3 | | | B | 1.33 |
| 6 | 3 | Sample as received. | 20.3 | T | 19.2 | 19.1 | 1.36 | T | 1.18 |
| | | | | M | 18.7 | | | M | 1.49 |
| | | | | B | 19.7 | | | B | 1.39 |
| 7 | 3 | Sample dried to reduce moisture content. | 17.1 | T | 17.9 | 17.8 | 1.12 | T | 1.09 |
| | | | | M | 18.2 | | | M | 1.14 |
| | | | | B | 17.3 | | | B | |

Specific gravity:
Sample 1 1.46
Sample 2 1.46
Sample 3 1.49

TABLE 2

| Run No | Sample No | Observed Behaviour |
|---|---|---|
| 1 | 1 | The cargo moved immediately around the box with roll and pitch - the amount of surface water increased during the run. |
| 2 | 2 | The cargo could be seen to move slightly with roll and pitch throughout the test and the free surface water mixed into the mass. Approx. 1½% of surface water removed before and between tests. |
| 3 | 2 | The cargo moved with roll and pitch. Approx. 1½% of surface water removed before test. |
| 4 | 2 | The cargo remained still throughout the run although a slight settlement occurred. |
| 5 | 2 | The cargo remained still throughout the test. |
| 6 | 3 | The top layer of the cargo moved with roll and pitch throughout the test. Lower layers were observed to remain still. |
| 7 | 3 | The cargo did not move during test and the surface remained matt in appearance, ie no water film. |

Of the seven coal slurry samples tested on the ship's motion simulator, four with moisture contents of 17.8% or more exhibited flow; three with moisture contents of 17.8% or below did not.

I claim:

1. A pumpable slurry of mineral particles in water comprising coarse mineral particles having a particle size in the range 5 to 50 mm and fine mineral particles having a size less than 200 micron, at least 30% by weight of the mineral particles being in the form of coarse particles, 10 to 40% by weight being in the form of fine particles and the balance to 100% by weight being intermediate sized particles, wherein the slurry contains 82 to 85% by weight of mineral particles based on the combined weight of the mineral particles and water.

2. A slurry according to claim 1 wherein the slurry contains 83 to 85% by weight of mineral particles.

3. A slurry according to claim 1 wherein at least 50% by weight of the fine particles are less than 100 micron in size.

4. A slurry according to claim 1 wherein the fine particles contain less than 10% by weight of particles having a particle size below 10 micron.

5. A slurry according to claim 1 wherein the mineral particles have a continuous particle size distribution.

6. A slurry according to claim 1 wherein the mineral particles are coal particles.

7. A method for transporting a slurry of mineral particles in water, which method comprises pumping through a pipeline a pumpable slurry of mineral particles in water comprising coarse mineral particles having a particle size in the range 5 to 50 mm and fine mineral particles having a size less than 200 micron wherein the slurry contains 65 to 80% by weight of mineral particles based on the combined weight of mineral particles and water, at least 30% by weight of the mineral particles being in the form of coarse particles, 10 to 40% by weight being in the form of fine particles and the balance to 100% being intermediate sized particles wherein the slurry is dewatered to give a solids content of from 82 to 85% by weight, and the dewatered slurry is pumped into a container for further transporting.

8. A method according to claim 7 wherein the container is a tank in a ship.

* * * * *